US006877746B1

(12) United States Patent
Herren et al.

(10) Patent No.: US 6,877,746 B1
(45) Date of Patent: Apr. 12, 2005

(54) BLACKJACK GAME

(76) Inventors: Jerry Herren, 1489 Rancho Ridge Dr., Las Vegas, NV (US) 89012; Joanie N. Herren, 1489 Rancho Ridge Dr., Las Vegas, NV (US) 89012

( * ) Notice: Subject to any disclaimer, the term of this patent is extended or adjusted under 35 U.S.C. 154(b) by 0 days.

(21) Appl. No.: 10/355,677

(22) Filed: Jan. 30, 2003

(51) Int. Cl.[7] ..... A63F 1/00

(52) U.S. Cl. ..... 273/292; 273/303; 273/304; 273/306

(58) Field of Search ..... 273/292, 303–306, 273/274, 309

(56) References Cited

U.S. PATENT DOCUMENTS

| | | | | | |
|---|---|---|---|---|---|
| 5,294,120 | A | | 3/1994 | Schultz | |
| 5,407,209 | A | | 4/1995 | Prerost | |
| 5,615,888 | A | * | 4/1997 | Lofink et al. | 273/292 |
| 5,660,392 | A | * | 8/1997 | Hansen | 273/292 |
| 5,820,128 | A | * | 10/1998 | Brunelle | 273/292 |
| 6,029,976 | A | | 2/2000 | Brunelle | |
| 6,065,753 | A | * | 5/2000 | Morosky | 273/292 |
| 6,189,888 | B1 | | 2/2001 | Brunelle | |
| 6,217,024 | B1 | * | 4/2001 | Lofink et al. | 273/292 |
| 6,227,969 | B1 | * | 5/2001 | Yoseloff | 463/13 |
| 6,386,973 | B1 | * | 5/2002 | Yoseloff | 463/13 |
| 6,422,565 | B1 | * | 7/2002 | Daines | 273/292 |
| 6,474,644 | B1 | | 11/2002 | Pickle et al. | |

* cited by examiner

*Primary Examiner*—Gregory Vidovich
*Assistant Examiner*—Dolores Collins
(74) *Attorney, Agent, or Firm*—Rob L. Phillips; Quirk & Tratos

(57) ABSTRACT

A live or electronically implemented blackjack game is disclosed wherein players are afforded the option of exchanging one or more of the players' dealt cards. Each player is given the option of exchanging one or both of an originally dealt two cards with a card or cards from one or more decks of playing cards being utilized to play the blackjack game. Each player must pay a fee for exchanging one or both of the cards. In a first embodiment, the fee is 50% of the player's original game wager. Players may also double down should they only exchange one of the first two dealt cards. Further, players may split the first two cards into two hands and exchange a first card dealt into each hand by paying the preestablished fee on each hand.

20 Claims, 3 Drawing Sheets

| DECKS | HOUSE EDGE |
|---|---|
| 8 | 1.09% |
| 7 | 1.08% |
| 6 | 1.07% |
| 5 | 1.04% |
| 4 | 1.01% |
| 3 | 0.96% |
| 2 | 0.85% |
| 1 | 0.52% |

100

FIG. 2

| DECKS | HOUSE EDGE |
|---|---|
| 8 | 1.40% |
| 7 | 1.39% |
| 6 | 1.38% |
| 5 | 1.35% |
| 4 | 1.32% |
| 3 | 1.27% |
| 2 | 1.16% |
| 1 | 0.83% |

110

FIG. 3

BLACKJACK GAME

FIELD OF INVENTION

The embodiments of the present invention relate generally to the wagering game of blackjack. More particularly, a blackjack game providing a player with an opportunity to improve his or her hand during play of the game.

BACKGROUND

The popularity of gaming has led, and continues to lead, to legalized gaming in more and more jurisdictions throughout the world. Certainly, legalized gaming has proliferated within the United States as a means for local governments to generate the revenue required to provide public services. Along with the increased gaming popularity has come the need for new and improved games of chance to keep the gaming public enamored. Over the course of the previous five to ten years electronic gaming machines, namely slot machines and video poker machines, have surpassed table games in both popularity and ability to generate revenue. Thus, the need for table games is especially warranted to attract those players unwilling to play electronic gaming machines.

The most popular table game in the history of casinos has been blackjack. The popularity of blackjack is a function of many features including, but not limited to, the speed of play, the simplicity of play, the small house edge, the known strategies for minimizing the house edge and the comradery of the players at the table setting.

Accordingly, blackjack is a game played with one or more standard decks of playing cards and is played against the dealer (i.e. the house). The dealer first deals each wagering player and himself or herself two cards. The players' cards are typically both face down and the dealer's two cards are dealt one face up and one face down. The object of the game is for the players to beat the value of the dealer's hand without going over a total card value of twenty-one. Once the initial two cards are dealt, the dealer engages the first player to the dealer's left and the player must hit, stand, split or double down. A hit results in the player taking one or more additional cards while stand indicates the player is satisfied with the total value of the two cards originally dealt. By hitting, the first player may take as many cards as desired until the total card value is satisfactory or the value of the cards exceeds twenty-one whereby the player busts and loses. If they have the same rank, the player may also split the two cards into two hands or may double down by placing a second wager equivalent to an original wager in exchange for taking a single additional card only. The dealer engages each player in clockwise fashion until each player has decided to hit, stand, split or double down. The dealer then reveals his or her face down card and plays according to preestablished casino rules. Although the casino rules can vary, generally, the dealer must hit any hand having a value of sixteen or less and stand on any hand seventeen or higher. Once the dealer completes his or her hand, the dealer compares his or her hand to each player's hand and resolves the wagers. Players are typically paid even money on winning wagers. However, should a player receive a two card hand having a value of twenty-one, known as blackjack, the player is typically paid three to two on the wager. Subtle rule differences exist between casinos but the basic underlying rules are as set forth above. As the various rule differences are known to those skilled in the art, they are not described in detail herein.

Most blackjack players understand a basic strategy associated with playing blackjack. The basic strategy focuses on the dealer's face up card and the assumption that the dealer's face down card has a value of ten. Therefore, if the dealer has a ten showing, the basic strategy dictates that the dealer has a hand valued at twenty. Players will then hit until they achieve a hand having a value of seventeen or higher to optimize their opportunity to win. Unfortunately, players holding hands valued at twelve through sixteen when the dealer has a high card (e.g. seven through ace) showing have a high risk of busting and losing. Frustration is common for players routinely receiving in-between valued hands while the dealer seemingly shows a high valued card each dealt hand. The only possible remedy available currently to the players is the option of surrendering. Surrendering allows a player to surrender his or her hand by forfeiting one-half of their original wager. Players surrender, if at all, when the dealer is showing a card having a value of nine, ten or ace and the player has a two-card hand valued at fifteen or sixteen. Unfortunately, the surrender option is often a poor play and affords the house a tremendous advantage.

Therefore, a more attractive player option continues to be missing from current forms of blackjack. U.S. patents disclose and claim blackjack variations of multiple types, including side wagers, bonus wagers and the option of playing multiple hands using one of the initially dealt two cards. However, to date, there is no option that provides players with the opportunity to improve the value of their dealt cards.

Accordingly, the embodiments of the present invention provide players with the opportunity to improve the quality of the players hand once the player has seen the hand and the dealer's face up card has been revealed.

SUMMARY

According to a first embodiment of the present invention, a player may exchange one or two initial blackjack cards by placing a fee equal to one half of their original wager in a fee area depicted on the table layout. The fee is immediately collected by the house. Thereafter, the game is played according to preestablished casino blackjack rules. Should a player elect to exchange one card only, the player may double down on the new card received. Should the player elect to split the initially dealt two cards, the player may exchange the first card dealt on each split hand. Each split hand will require the fee to be paid.

In this arrangement, players are provided the opportunity to improve blackjack hands having a poor chance of winning. For example, should the player receive a ten and a six and the dealer is showing a ten, the player would normally hit pursuant to the basic strategy and on a majority of occasions will bust and lose the hand. However, under the embodiments of the present invention, the player may pay the fee equal to half of the original wager and the dealer removes the six and replaces it with the first card from the deck or decks. While the player's hand may not be significantly improved (e.g. player receives a five) the player has the opportunity to significantly improve the hand (e.g. player receives an ace). Ultimately, players will have to decide the prudence of exchanging a card or cards given the circumstances and the strategy the individual player wishes to employ. Suffice it to say, the player is afforded an option heretofore not available with traditional blackjack or the many variations disclosed in the U.S. patents directed to blackjack.

BRIEF DESCRIPTION OF THE DRAWINGS

FIG. 2 illustrates a first table depicting house edge associated with the embodiments of the present invention;

FIG. 3 illustrates a second table depicting house edge associated with the embodiments of the present invention.

DETAILED DISCLOSURE

Figure 1:
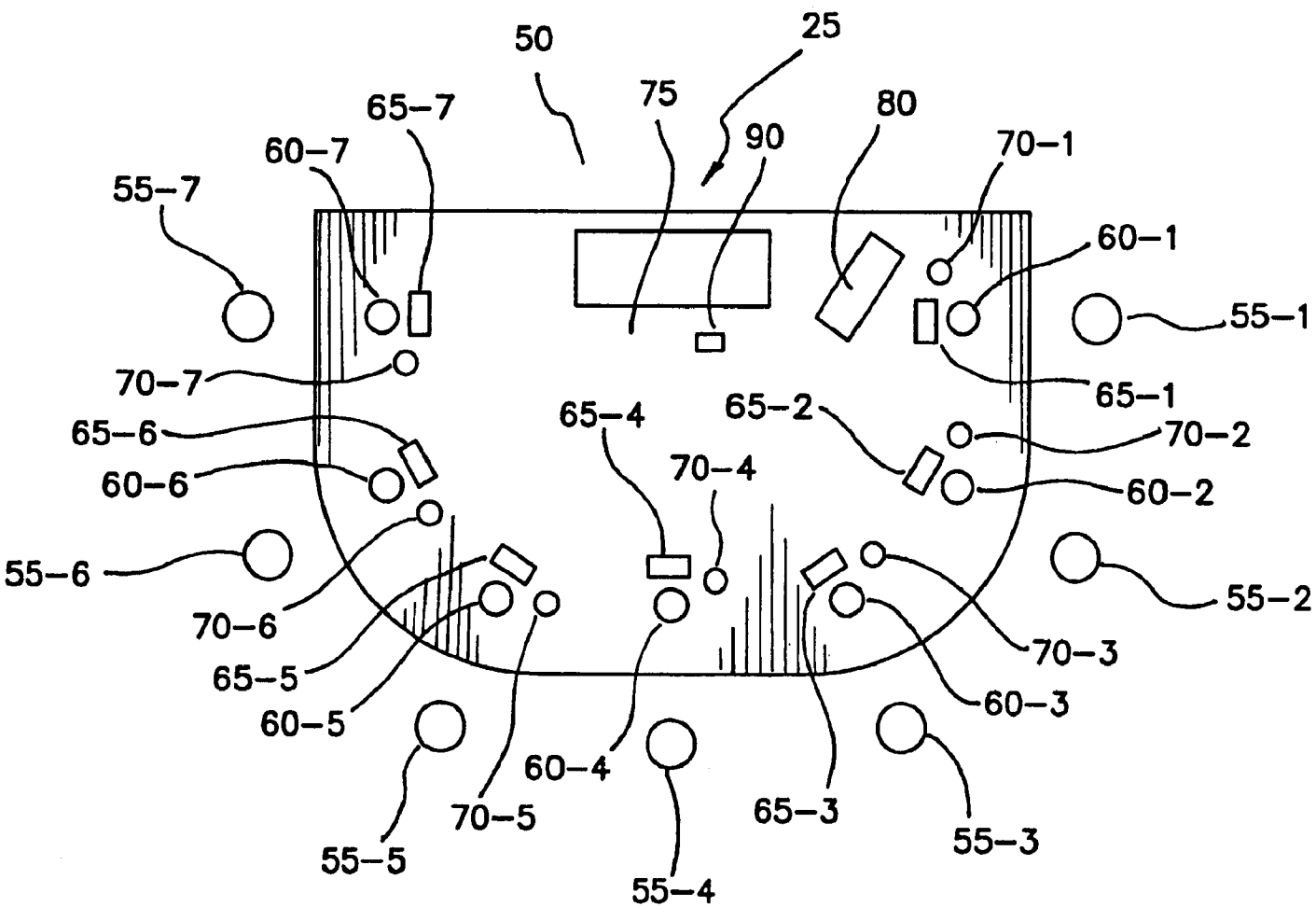
FIG. 1 illustrates a gaming table layout for practicing the embodiments of the present invention.

Referring to FIG. 1, a gaming table layout generally designated as reference numeral 25 includes a dealer position 50, seven player positions 55-1 through 55-7, seven primary wager areas 60-1 through 60-7, seven player card areas 65-1 through 65-7, seven fee areas 70-1 through 70-7 and a dealer card area 75. Other than the fee areas 70-1 through 70-7, the gaming table layout 25 is generally identical to a standard blackjack table layout.

Also positioned on, or near, the table layout 25 is a card shoe 80 for holding one or more decks of standard playing cards, a chip tray 85 for holding chips for paying and collecting wagers and an incorporated device 90 for a dealer to check his or her hand for blackjack. While not shown, an automatic shuffling machine will also likely rest on, or near, the table layout 25. Other than some single deck blackjack games, automatic shuffling machines are employed at most blackjack tables to reduce the card shuffling time thereby increasing the number of hands dealt per hour. The embodiments of the present invention can be facilitated by both dealer shuffles and automatic card shufflers.

As with conventional blackjack, players first place their primary wager in the primary wagering areas 60-1 through 60-7. Once each participating player has placed a primary wager, the dealer deals each player and himself or herself two cards. The players' cards may be dealt both face up or both face down depending on the rules of the casino. In all instances, the dealers cards are dealt one face up and one face down. Conventionally, the player at the position farthest left of the dealer plays against the dealer first. Thus, should a player be seated at position 55-1, he or she is the first player to make a decision to hit, stand, split, double down or exchange a card or cards according to the rules of the embodiments of the present invention. The description below assumes the first player is seated at player position 55-1.

Should the player be satisfied with the value of the original two cards, the player may simply stand without utilizing the opportunity to hit or exchange either or both of the two cards. Alternatively, should the player desire to hit the hand, the player may do so as many times as the player likes until the value of the cards is satisfactory to the player or the hand busts and the player loses. The player may also split the cards if they have the same rank or the player may double down on the primary wager according to the rules of conventional blackjack. According to the embodiments of the present invention, the player may also elect to exchange one or both of the dealt cards. Should the player make the election to exchange one or both cards, the player first places a fee in the fee area 70-1. In a first embodiment of the present invention, the fee is equal to half the amount of the primary wager and the player may only place one fee during the play of each hand. Therefore, if the player had placed a $100 primary wager, the fee must be in the amount of $50. Moreover, once placed, the fee is immediately collected by the dealer. In effect, the player has reduced his or her original wager by 50% in return for the opportunity to exchange one or both cards. While the fee is described as 50% of the original wager, the amount of the fee can be varied to suit the needs of the casino offering the exchange option.

Alternatively, the fee can be varied depending on whether one or two cards are exchanged. For example, should one card be exchanged the fee may be set at a first amount while exchanging both cards requires a larger second fee. Again, the fee schedule can be varied depending on the needs of the casino implementing the embodiments of the present invention.

Once the fee is placed and collected, the player signals to the dealer that he or she wishes to exchange one or both cards by tossing one or both of the cards face up in the direction of the dealer in the same manner as players conventionally toss cards face up when their hand busts. Alternatively, players may place the card or cards to be exchanged adjacent to the fee being placed. Any means for notifying the dealer of the player's intent to exchange cards may be used. In fact, casinos will likely develop their own procedures analogous to their current security procedures related to table games like blackjack. Once the dealer determines which card or cards are being exchanged, the dealer will place the card or cards into the pile of cards to be shuffled and will then take the next card or cards from the shoe 80 and deal them to the player.

If the player exchanges one card only, the player is permitted to double down on the primary wager. That is, the player may double the primary wager but may only take one additional card as is commonly done in conventional blackjack games. Typically, doubling down occurs when the player holds a hand valued at nine, ten or eleven and the dealer shows a small to mid-range card such as a two through eight. The player is hoping to receive a large card such as a ten or ace when holding a hand valued at nine or ten or a ten or ace when holding a hand valued at ten. Should the player exchange two cards, the double down option is unavailable in the first embodiment of the present invention.

Should the player decide to split the original two cards dealt, the player may elect to exchange the first card dealt on each split card. Since the player must place a second primary wager for the second hand, the player may place the fee for each separate hand if desired. For example, if the player decides to split a pair of eights as is suggested by the basic strategy, the player must place a second wager equal in value to the primary wager. The dealer will then separate the wagers and the two cards being split into two hands. Thereafter, the dealer deals a single card on the first split eight and the player then has the option of standing, hitting or exchanging the dealt card. Should the player elect to exchange the card, the player places a fee in the fee area 70-1 and the dealer collects the fee and takes the card being exchanged. The dealer then deals a replacement card to the player. The hand is then completed according to the conventional rules of blackjack. Once the first hand is completed, the dealer deals a single card on the second split eight. At this point, the player once again has the option of splitting the cards if the value of the second card is an eight, standing, hitting or exchanging the dealt card. Should the player elect to exchange the card, the player places a fee in the fee area 70-1 and the dealer collects the fee and takes the card being exchanged. The dealer then deals a replacement card to the player. The hand is then completed according to the conventional rules of blackjack. The casino may opt to allow the player to split hands if the replacement card matches the original split card and may allow the player to double down on the total of the replacement card and the original card. Such options are at the discretion of the casinos and are based on the house edge ultimately desired.

Now referring to FIGS. 2 and 3, tables 100, 110 depict the house edge calculated as a function of the number of standard decks of playing cards used to deal the blackjack game and the ultimate payout for a blackjack achieved after one or two cards have been exchanged. The house edge in any blackjack game can be changed by altering the underlying rules of the game. For example, many casinos now pay 6 to 5 on a single deck blackjack rather than the traditional 3 to 2. Thus, the house edge is increased. Table 100 is based on a blackjack payout of 6 to 5 on any hand before or after an exchange. Table 110 is based on a blackjack payout of 6 to 5 if no exchange occurs and an even money payout if any exchange occurs. As can be seen, the house edge increases in table 110 since the payout for blackjack after any exchange has been lowered. It should be understood that the house edges set forth in tables 100, 110 are exemplary and ultimately the casino implementing the embodiments of the present invention will determine the house edge. Moreover, subtle changes to the underlying blackjack rules, including the availability of surrender and the number of allowable splits, will influence the house edge.

While the embodiments of the present invention have been described in reference to a live table game, electronic video gaming machines may also be employed to offer players the availability of the exchange option. As indicated above, gaming machines have proliferated the casinos. The most popular video gaming machine is that associated with video poker. Video poker allows a player to play draw poker against a pay table setting forth different payouts based on the ultimate poker hand achieved by the player. More recently, video gaming machines have also been used to permit players to play blackjack against a simulated dealer. The rules are typically the same but the player does not have to wait for other table players to make decisions or embarrass themselves by playing contrary to known strategies.

Figure 4:
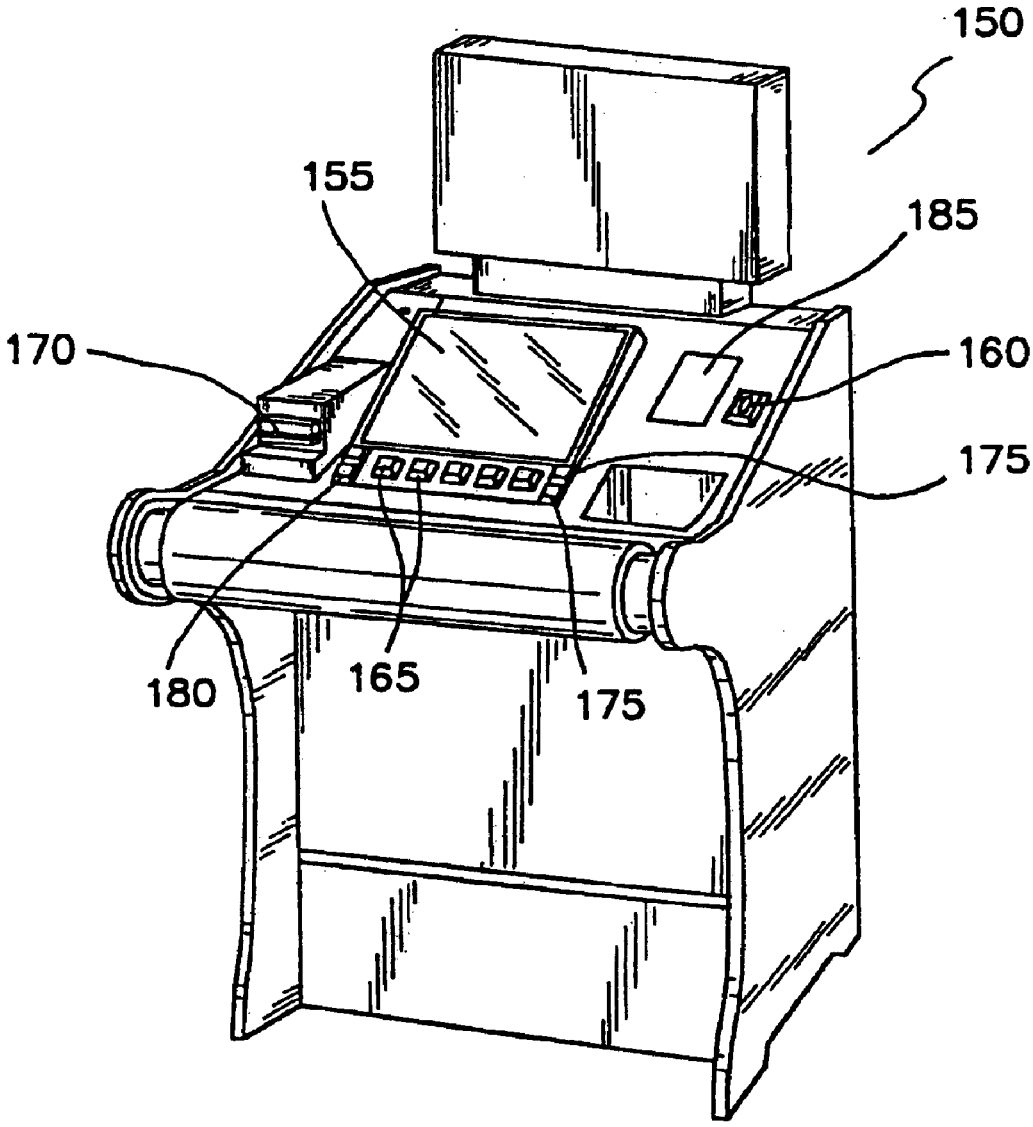
FIG. 4 illustrates a gaming machine associated with an electronically implemented embodiment of the present invention.

Video gaming machines generally include at least a microprocessor, a memory device, a display and interface means for players to instruct the machine. FIG. 4 shows a conventional gaming machine 150 which can be used to implement the embodiments of the present invention. It is understood that the appearance and arrangement of the machine features are not critical to the operation of the embodiments of the present invention. The gaming machine 150 includes a display 155, a coin slot 160, selection buttons 165, card reader 170, wager buttons 175 and cash out buttons 180. The precise details of the operation of gaming machines are well known to those skilled in the art and, for the sake of brevity, are not intimately described herein.

In a gaming machine embodiment, a player first inserts a wager according to the denomination of the machine 150. Alternatively, the player may insert a large amount of money which is credited and displayed on a credit display 185. Once the player has caused the machine 150 to identify the amount of the wager, the machine 150 causes the player to receive two displayed face up cards and the dealer receives one face up card and one face down card. Should the player elect to exchange one or both cards, the player either uses touchscreen technology to identify which card or cards are being exchanged or the player may use selection buttons 165 to identify the subject card or cards. If the player has placed a wager equal to the machine denomination (e.g. $5), the machine 150 will prompt the player to insert the fee equal to one half of the player's wager. If the player is playing on machine credit, the machine 150 will automatically deduct the fee from the player's remaining credits. Thereafter, the player and machine 150 proceed according to the conventional rules of blackjack. Morever, the gaming machine embodiment can be programmed to permit double downs and splits. As with the table game embodiments of the present invention, the house edge of the gaming machine embodiment can be changed by altering the rules programmed into the processor.

In any of the embodiments of the present invention, the underlying blackjack rules can be changed to alter the house edge. Therefore, the 6 to 5 payout associated with blackjack may be changed to the traditional 3 to 2 as long as one or more underlying blackjack rules are changed to maintain an acceptable house edge.

The embodiments of the present invention have been described in detail with respect to a live table game or a video gaming machine within a casino environment. However, the embodiments of the present invention may be implemented over a local area computer network or global computer network, including the Internet, as well. Therefore, a player may access a gaming website offering the option of exchanging one or more cards of a simulated blackjack hand. Other than the method of placing wagers, the computer network embodiment is carried out in an analogous fashion to the gaming machine embodiment.

Although the invention has been described in detail with reference to the specific embodiments, additional variations and modifications exist within the scope and spirit of the invention as described and defined in the following claims.

We claim:

1. A method of playing a wagering blackjack game against a gaming establishment with one or more decks of conventional playing cards comprising the steps of:

accepting a player wager;

dealing the player and a dealer two cards;

providing the player the option of exchanging one or both of the player's two dealt cards with remaining cards in the one or more decks of playing cards such that should the player elect the option of exchanging one or both of the player's two dealt cards said player being required to pay, in addition to said slayer wager, a fee to the gaming establishment operating the blackjack game;

completing the blackjack game pursuant to preestablished rules of the blackjack game; and resolving the player wager pursuant to preestablished payouts.

2. The method of claim 1 wherein the fee equals one half of the player wager.

3. The method of claim 1 wherein should the player elect to split the two dealt cards into two separate hands, the player is provided the option of exchanging a first card dealt to each separate hand by paying the fee for each card exchanged.

4. The method of claim 1 wherein should the player elect to exchange one of the two dealt cards by paying the fee, the player may double down on the one original card and the one new card.

5. The method of claim 1 wherein a hand of blackjack pays the player 6 to 5.

6. The method of claim 1 wherein should the player elect to exchange one card the fee is less than if the player elects to exchange both cards.

7. An electronically implemented method of playing a blackjack game comprising the steps of:

accepting a player wager;

displaying two player cards face up and two cards of a simulated dealer;

providing the player the option of exchanging one or both of the player's two displayed cards with remaining cards in one or more simulated decks of playing cards such that should the player elect the option of exchanging one or both of the player's two displayed cards said player being required to pay, in addition to said slayer wager, a fee;

completing the blackjack game pursuant to preestablished rules of the blackjack game; and resolving the player wager pursuant to preestablished payouts.

8. The method of claim 7 wherein the fee equals fifty percent of the player wager.

9. The method of claim 7 wherein should the player elect to split the two displayed cards into two separate hands, the player is provided the option of exchanging a first card displayed to each separate hand by paying the fee for each card exchanged.

10. The method of claim 7 wherein should the player elect to exchange one of the two originally displayed cards by paying the fee, the player may double down on the one original card and the one new card.

11. The method of claim 7 wherein a payout for a hand of blackjack pays the player 6 to 5.

12. The method of claim 7 wherein should the player elect to exchange one card the fee is less than if the player elects to exchange two cards.

13. A gaming machine comprising:

a machine processor for controlling a game of simulated blackjack;

a display for displaying the simulated game of blackjack;

means for accepting a player wager; and selection means for a player to exchange one or both of the player's first two displayed cards of the simulated blackjack game such that should the player elect the option of exchanging one or both of the player's first two displayed cards said player being required to pay, in addition to said slayer wager, a fee.

14. The machine of claim 13 wherein the selections means is a touchscreen display.

15. The machine of claim 13 wherein the fee equals one half of the player wager.

16. The machine of claim 13 wherein should the player elect to split the first two displayed cards into two separate hands the player is provided the option of exchanging a first card displayed to each separate hand by paying the fee for each separate hand.

17. The machine of claim 13 wherein should the player elect to exchange one of the two originally displayed cards by paying the fee, the player may double down on the one original card and the one new card.

18. The machine of claim 13 wherein a hand of blackjack pays the player 6 to 5.

19. The machine of claim 13 wherein should a player elect to exchange one card the fee is less than if the player elects to exchange both cards.

20. The machine of claim 13 wherein the fee is automatically deducted from stored and displayed player credits once the player uses the selection means to exchange at least one of the first two dealt cards.

* * * * *

UNITED STATES PATENT AND TRADEMARK OFFICE

CERTIFICATE OF CORRECTION

PATENT NO. : 6,877,746 B1
DATED : April 12, 2005
INVENTOR(S) : Jerry Herren et al.

It is certified that error appears in the above-identified patent and that said Letters Patent is hereby corrected as shown below:

Column 6,
Line 38, please change "slayer" to -- player --.

Column 7,
Line 4, please change "slayer" to -- player --.

Column 8,
Line 6, please change "slayer" to -- player --.

Signed and Sealed this

Seventh Day of June, 2005

JON W. DUDAS
*Director of the United States Patent and Trademark Office*